US007905171B1

(12) United States Patent
Brittingham

(10) Patent No.: US 7,905,171 B1
(45) Date of Patent: Mar. 15, 2011

(54) NOISE REDUCING BOOSTER INSERT

(75) Inventor: Kevin Tyson Brittingham, Norcross, GA (US)

(73) Assignee: Advanced Armament Corp., LLC, Lawrenceville, GA (US)

( * ) Notice: Subject to any disclaimer, the term of this patent is extended or adjusted under 35 U.S.C. 154(b) by 270 days.

(21) Appl. No.: 11/906,652

(22) Filed: Oct. 3, 2007

(51) Int. Cl.
*F41A 21/00* (2006.01)

(52) U.S. Cl. ..... 89/36.08; 89/14.4

(58) Field of Classification Search ..... 89/14.05–14.5, 89/36.08
See application file for complete search history.

(56) References Cited

U.S. PATENT DOCUMENTS 5,029,512 A * 7/1991 Latka ..... 89/14.4
5,596,161 A * 1/1997 Sommers ..... 89/14.2
5,773,746 A * 6/1998 Vaden ..... 89/14.4
6,722,254 B1 * 4/2004 Davies ..... 89/14.3
7,588,122 B2 * 9/2009 Brittingham ..... 181/223
7,594,464 B2 * 9/2009 Dueck ..... 89/14.4
2006/0060076 A1 * 3/2006 Dueck et al. ..... 89/14.4

OTHER PUBLICATIONS

AAC GLOCK 9mm Suppressors, for GLOCK 17, 19, and 26 with AAC Evolution-9, Spider-2, Scorpion!; by Al Paulson; Combat Handguns; Harris Publications; Jun. 2006 issue.*

AAC's Evolution-9, Suppressing hard-to-silence 9mm pistols including Beretta 92F; by Al Paulson; Special Weapons for Military and Police; Harris Publications; Fall 2002 issue.*

* cited by examiner

*Primary Examiner* — Michael Carone
*Assistant Examiner* — Gabriel J Klein
(74) *Attorney, Agent, or Firm* — Wood, Herron & Evans, LLP

(57) ABSTRACT

A noise reducing booster insert of a sound suppressor coupled to a barrel of a firearm includes an elongate body, a plurality of gas vents, and a plurality of indexing spokes. The gas vents permit expanding gases from the firearm to fill a space about the body to thereby increase noise reduction without the need of modifying a baffle stack of the sound suppressor. The gas vents are angled such that the expanding gases force the booster insert to rotate into tighter threaded engagement with the barrel of the firearm.

6 Claims, 2 Drawing Sheets

VIEW A-A

NOISE REDUCING BOOSTER INSERT

BACKGROUND OF THE INVENTION

1. Field of Invention

This device relates to handgun sound suppressors, specifically to coupling attachments which are threadedly secured about a handgun barrel which are designed to aid in sound reduction when used in conjunction with a noise suppressor. Further, this device aids in the prevention of the sound suppressor from unthreading from the handgun barrel due to the incidental vibrations related to discharging the firearm.

2. Prior Art

There is always a need to improve the sound reduction of a sound suppressor. Generally inventors focus on improving baffle design. The device of the invention works by manipulating the expanding gases exiting a firearm prior to contact with the blast baffle.

Previous systems exist for attaching a sound suppressor to a handgun barrel. Devices such as the A.S.A.P system, commercially available from Advanced Armament Corp. of Norcorss, Ga., utilize a threaded insert which rest within a cylindrical housing located at the back end of a silencer. Through the use of vent holes around the periphery, the expanding gases from the discharging firearm fill a booster chamber and assist the handgun during its firing cycle.

Another design is the Linear Inertial Decoupler device commercially available from Gemini Technologies, Inc. of Boise Id., which is similar to the Advanced Armament A.S.A.P system. Both designs are incorporated into the rear of the silencer and simply provide a means to cycle a handgun during its semi-automatic firing cycle. Some sound reduction may be gained from these designs but the noise inherent to the threaded insert being forced around inside of its housing also generates noise in its own right.

There is always a demand for increased noise reduction from a sound suppressor. While the above represent designs which are functional for their primary purpose, to operate semi-automatic handguns, they do not provide for optimal sound reduction. The design of this invention addresses this later concern with the capability of being adapted to function as an insert in most booster designs.

Vibration resulting from the discharge of the host weapon can cause a sound suppressor which is threadedly secured about a handgun barrel to unscrew. Sound suppressor manufacturers currently address this deficiency by tightening the specifications of the threaded insert. This tightening works with varying degrees of success, but always leaves the potential of not being universally compatible with a variety of manufacturers' handgun barrels. There is a need for a method of securing a thread mount sound suppressor onto a hand gun barrel which is neither permanent nor dependant on a tight thread specification.

OBJECTS AND ADVANTAGES

Accordingly, several objects and advantages of the present invention are (a) To provide an apparatus which will increase the sound suppression capability of a noise suppressor without modifying the baffle stack; (b) To provide an apparatus which improves the performance of a sound suppressor and can be easily adapted to existing sound suppressor booster designs; and (c) To provide an apparatus which, when incorporated onto the thread insert of a sound suppressor booster, will help rotationally restrain the sound suppressor while the handgun is being discharged.

Still further objects and advantages will become apparent from a consideration of the ensuing description and drawings.

SUMMARY

In general terms the proposed apparatus is a threaded insert referred to commonly as a piston. This threaded insert when used with a sound suppressor is designed to threadedly secure the noise suppressor onto the barrel of a handgun.

Two features have been designed into the piston, but are not limited to use with the booster system which is associated with a preferred embodiment. The piston includes five vents which run parallel to the longitudinal path of the bore. The five vents are cut into the piston body at a 72 degree angle from a radial direction. The 72 degree angle of the vents are machined to follow the direction of the specified thread pitch located on the thread mount portion of the piston. If the piston has a right hand thread then the vents are cut to face the right for example. By machining the vents at a 72 degree angle from a radial direction the expanding gases passing from the discharging firearm are being redirected to the side of bore line. This redirection more effectively utilizes the noise suppressor's internal volume thereby providing more time for the gases to cool. Turbulence is created by this venting of gases allowing the associated gases more time to cool and expand thereby reducing the sound and flash signature of the host firearm. As the gases pass over the angled area of the five vents, the piston and thereby the noise suppressor are being forced to rotate in the same direction which will tighten the piston onto the handgun barrel. The proposed apparatus is not limited to the specific angle, or number of vents outlined above.

BRIEF DESCRIPTION OF THE DRAWINGS

The novel features believed to be characteristic of the invention, together with further advantages thereof, will be better understood from the following description considered in connection with the accompanying drawings, in which a preferred embodiment of the present invention is illustrated by way of example. It is to be expressly understood, however, that the drawings are for the purpose of illustration and description only, and are not intended as a definition of the limits of the invention.

DETAILED DESCRIPTION OF THE PREFERRED EMBODIMENT

Figure 1:
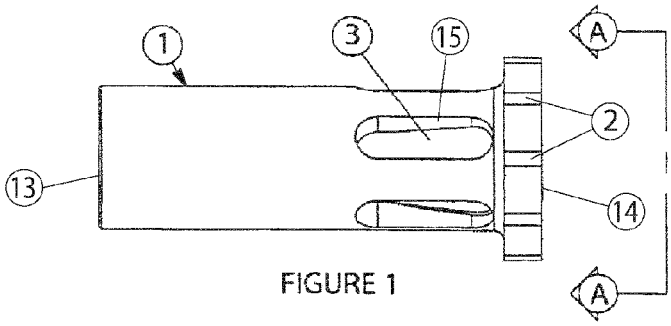
FIG. 1 shows an external side view of one embodiment of a noise reducing booster insert, also referred to as a piston.

Turning now to the drawings in which like reference characters indicate corresponding elements throughout the several views, attention is directed to FIGS. 1-4, which illustrate the preferred embodiment of a noise reducing booster insert 1, hereinafter referred to as the piston 1, and FIG. 5, which illustrates the piston 1 in use with a noise suppressor and a firearm 5. As shown in FIG. 1, the piston 1 includes gas vents 3 which are machined near a front or exit end 14 of the piston 1. Ten indexing spokes 2 with notches there between are also located at the exit end 14 of the piston 1.

Figure 2:
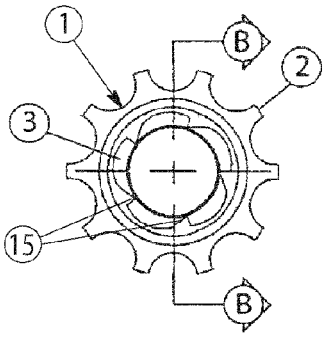
FIG. 2 shows a front view of the noise reducing booster insert of FIG. 1.

In FIG. 2, there is illustrated a view of the exit end 14 of the piston 1. The number of indexing spokes 2 and how they are oriented are clearly illustrated. These spokes 2 and notches allow the user to change the rotational orientation of the host noise suppressor 6 and its baffles in relation to the barrel 7 of the firearm 5. By pulling longitudinally forward on the noise suppressor 6 and twisting the noise suppressor 6 with respect to the barrel 7, the orientation of the noise suppressor 6 will change. The indexing spokes 2 will then retain the noise suppressor 6 in the new desired position. Another feature illustrated is the gas vents 3. The gas vents 3 extend longitudinally parallel to the axis a-a of the piston 1 and are angled axially at the vent side edges 15 in a consistent tangential direction corresponding to the thread direction of internal threads 4 located at a rear end 13 of the piston 1. In this regard, the gas vents 3 are axially angled to the right for a right hand twist thread, or to the left for a left hand twist thread to allow the expanding gases to place pressure on the angled side edges 15 of the vents 3 and prevent the piston 1 from unthreading while the firearm 5 is being discharged.

Figure 3:
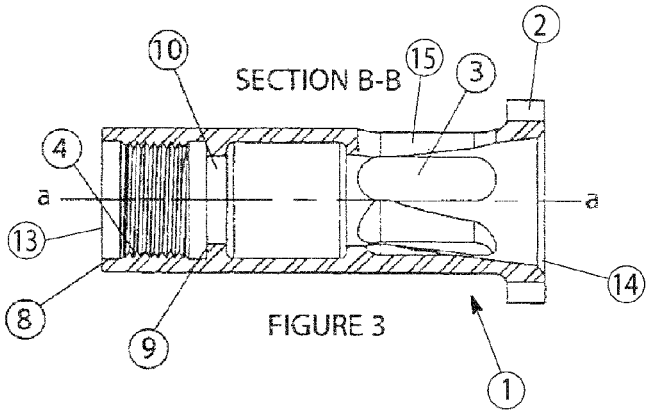
FIG. 3 shows an internal side view of the noise reducing booster insert of FIG. 1.
Figure 4:
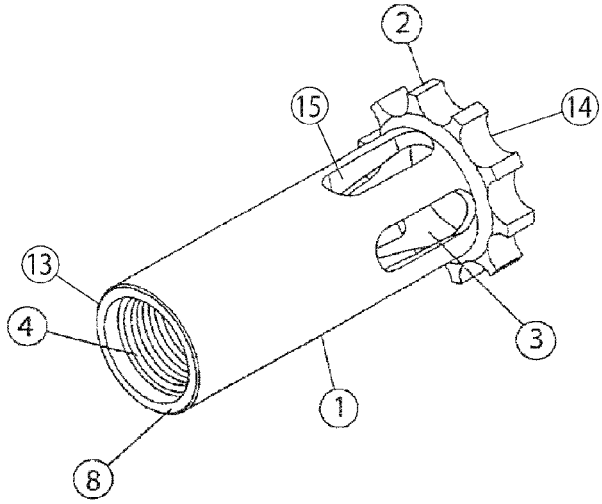
FIG. 4 shows an angled, perspective view of the noise reducing booster insert of FIG. 1.

In FIG. 3, there is illustrated a horizontal cutaway view of the preferred embodiment piston 1. The aforementioned internal threads 4 are located at the rear end 13 of the piston 1. The threads 4 can be of a length, pitch and direction corresponding to the threaded end 16 of the barrel 7 of the firearm 5 being utilized. A small gap is left between the rear end 13 of the piston 1 and the threads 4 to serve as a rear shoulder 8. A stop surface 9 is present for the muzzle end of a barrel 7 to abut when the piston 1 is attached to the firearm 5. The piston 1 defines a clear axial passageway for a projectile, the passageway being no smaller than the exit aperture 10. Gas vents 3 are located forward of the exit aperture 10 and adjacent to the exit end 14 of the piston 1 and are equally spaced about the periphery of the piston 1. The indexing spokes 2 are located forward of the gas vents 3 at the exit end 14 of the piston 1. FIG. 4 further illustrates these features of the piston 1.

Figure 5:
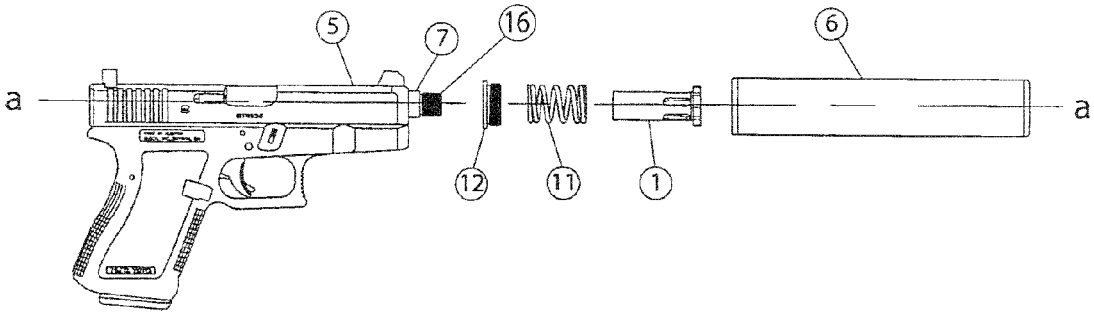
FIG. 5 shows an exploded side view of a noise suppressor and handgun incorporating the noise reducing booster insert of FIG. 1.

Illustrated in FIG. 5, there is an external view of the piston 1 and its location within the overall noise suppressor 6 and firearm 5 assembly. The piston 1 is inserted into the noise suppressor 6 and a compression spring 11 and rear cap 12 are placed about the piston 1 at the rear end 13. The rear cap 12 threadedly secures to the noise suppressor 6 to position the spring 11 between the rear cap 12 and the indexing spokes 2 of the piston 1. The rear end 13 of the piston is then threadedly secured onto the threaded end 16 of the barrel 7.

As used herein, the word "front" or "forward" corresponds to the firing direction of the firearm (i.e., to the right as shown in FIGS. 1, 3, 4, and 5); "rear" or "rearward" or "back" corresponds to the direction opposite the firing direction of the firearm (i.e., to the left as shown in FIGS. 1,3,4, and 5); "longitudinal" means the direction along or parallel to the longitudinal axis a-a of the piston 1; and "transverse" or "axial" means a direction perpendicular to the longitudinal direction.

The pitch and diameter of the barrel 7 are not confined to the M13.5×1LH specification illustrated with the preferred embodiment of the piston 1. It should be noted that any popular thread pitch that can be machined on the piston 1 to work with any threaded barrel 7.

Prior to discharging the host firearm 5, the piston 1 and the noise suppressor 6 are in a first position. When the firearm discharges, the noise suppressor 6 is filled with expanding gases, which force the noise suppressor 6 forward with respect to the piston 1 and the barrel 7 against the bias of the spring 11. The spring 11 is compressed in this second position of the noise suppressor 6.

More specifically, discharging a firearm 5 forces gases and a bullet through the barrel 7 and piston 1. As the gases enter the piston 1, the gas vents 3 located about the periphery of the piston 1 direct some of the expanding gases to the chamber located about the piston 1 and within the noise suppressor 6. The bullet will pass along the longitudinal axis a-a unobstructed through the noise suppressor 6. As the expanding gases fill the area around the periphery of the piston 1, the gases place forward pressure against the noise suppressor 6 while at the same time forcing the action of the firearm 5 to travel in a rearward path, effectively placing the noise suppressor 6 in the second position. The spring 11 resists the forward movement of the noise suppressor 6, and once the gases have begun to exit the noise suppressor 6, the spring 11 forces the noise suppressor 6 back to the first position. Furthermore, while the gases are passing through the gas vents 3, pressure is being applied against the angled vent side edges 15 to force the piston 1 in a rotational direction that tends to tighten the piston 1 onto the barrel 7 and the threads 4. This is superior to other designs which do not utilize this force that is inherent to the use of a firearm 5.

Gases which result from discharging a firearm 5 contain unburnt powder particles. As these gun powder particles contact oxygen, they can combust to create flash and sound. Directing the expanding gases to pass through the angled vent side edges 15 of the piston 1 slows the velocity of the gas particles and cools the gas. By slowing and cooling the gases, gasses overall combustion of unburnt gun powder is reduced, thereby effectively reducing the overall flash and sound signature of the host noise suppressor 6.

CONCLUSION, RAMIFICATIONS, AND SCOPE

Accordingly the reader will see that the apparatus of the invention, when incorporated into a noise suppressor 6, will further reduce the overall sound signature of a discharging firearm 5. As a secondary benefit the expanding gases from the discharging firearm 5 will apply pressure to the angled gas vents 3 on the piston 1 effectively resisting the natural tendency of the piston 1 to threadedly disconnect from the firearm 5 because of the incidental vibration of a discharging firearm 5.

While the above drawings and description contain many specificities, these should not be construed as limitations on the scope of the invention, but rather as an exemplification of one preferred embodiment thereof. For example, the design is not limited to working with Advanced Armament Corporation's A.S.A.P system, previously described. The angled rectangle cuts, key to the sound reduction benefit, can be incorporated into other sound suppressor booster designs. In this regard, an insert for a sound suppressor which does not utilize a moving piston is another possibility for the design.

Accordingly, the scope of the invention should be determined not by the embodiments illustrated, but by the appended claims and their legal equivalents.

The invention claimed is:

1. A noise reducing piston for a firearm sound suppressor booster configured for use with a firearm having a barrel, the piston comprising:

an elongated body defining a rear end, a forward end, a peripheral surface, and a longitudinal axis;

a central bore through the body extending from the rear end to the forward end and sized to allow passage of a projectile fired from the barrel;

internal threads adjacent the rear end of the body and configured to couple the body to the barrel;

a plurality of elongate gas vents disposed forward of the internal threads and extending from the central bore to the peripheral surface, each gas vent being linear and elongated only in a direction parallel to the longitudinal axis of the body; and a plurality of indexing spokes disposed on the peripheral surface of the body forward of the gas vent and the gas vents permit expansion of gases accompanying discharge of the firearm into a space between the peripheral surface of the body and the sound suppressor, and wherein the internal threads are rotated for tightening in a first direction and side edges of the vents are angled in a corresponding direction such that expanding gases passing through the plurality of gas vents tends to rotate the body in the first direction and tighten the coupling between the body and the barrel of the firearm.

2. The noise reducing piston of claim 1, wherein the plurality of gas vents are substantially equally spaced circumferentially around the peripheral surface of the body.

3. The noise reducing piston of claim 1, wherein the plurality of indexing spokes are configured to retain the sound suppressor in a desired rotational orientation.

4. A sound suppressor configured for use with a firearm having a barrel, the sound suppressor comprising:

a sound suppressor body having a rear end;

a sound suppressor booster including a longitudinally slidable piston disposed in the suppressor body, said piston comprising:

an elongated piston body defining a rear end, a forward end, a peripheral surface, and a longitudinal axis;

a central bore through the piston body extending from the rear end to the forward end and sized to allow passage of a projectile fired from the barrel;

internal threads adjacent the rear end of the piston body and configured to couple the piston body to the barrel;

a plurality of elongate gas vents disposed forward of the internal threads and extending from the central bore to the peripheral surface, each gas vent being linear and elongated only in a direction parallel to the longitudinal axis of the piston body; and a plurality of indexing spokes disposed on the peripheral surface of the piston body forward of the gas vent and defining an interior diameter of the sound suppressor booster; and a spring disposed about the body of the piston and within the silencer body, wherein the sound suppressor is configured to slide forward from a first position to a second position, compressing the spring, when a projectile is fired from the firearm and the gas vents permit expansion of gases accompanying discharge of the firearm into a space between the peripheral surface of the piston body and an interior surface of the suppressor body, and further wherein the internal threads are rotated for tightening in a first direction and side edges of the vents are angled in a corresponding direction such that expanding gases passing through the plurality of gas vents tends to rotate the piston body in the first direction and tighten the coupling between the piston body and the barrel of the firearm.

5. The sound suppressor of claim 4, the piston body comprising a plurality of gas vents substantially equally spaced circumferentially around the peripheral surface of the body.

6. The sound suppressor of claim 4, wherein the plurality of indexing spokes are configured to retain the sound suppressor in a desired rotational orientation.

* * * * *